US005089095A

United States Patent [19]

Cawlfield et al.

[11] Patent Number: 5,089,095

[45] Date of Patent: Feb. 18, 1992

[54] ELECTROCHEMICAL PROCESS FOR PRODUCING CHLORINE DIOXIDE FROM CHLORIC ACID

[75] Inventors: David W. Cawlfield; Jerry J. Kaczur, both of Cleveland; Budd L. Duncan, McMinn; Sudhir K. Mendiratta, Cleveland; Ronald L. Dotson, Cleveland; Kenneth E. Woodard, Jr., Cleveland, all of Tenn.

[73] Assignee: Olin Corporation, Chesire, Conn.

[21] Appl. No.: 502,206

[22] Filed: Mar. 30, 1990

[51] Int. Cl.[5] ..... C25B 1/26

[52] U.S. Cl. ..... 204/101; 204/95; 204/103; 204/128; 423/473; 423/477

[58] Field of Search ..... 204/95, 96, 98, 101, 204/103, 128; 423/472, 473, 475, 477

[56] References Cited

U.S. PATENT DOCUMENTS

| | | | |
|---|---|---|---|
| 2,163,793 | 6/1937 | Logan | 204/9 |
| 2,347,151 | 4/1944 | Crawford et al. | 423/473 |
| 2,717,237 | 9/1955 | Rempel | 204/101 |
| 3,763,006 | 10/1973 | Callerame | 204/103 |
| 3,810,969 | 5/1974 | Schlumberger | 423/478 |
| 3,904,496 | 9/1975 | Harke et al. | 204/98 |
| 4,146,578 | 3/1979 | Brennan et al. | 423/473 |
| 4,542,008 | 9/1985 | Capuano et al. | 423/477 |
| 4,798,715 | 1/1989 | Hardee et al. | 423/478 |

FOREIGN PATENT DOCUMENTS

| | | |
|---|---|---|
| 186655 | 3/1956 | Japan . |
| 4569 | 6/1958 | Japan . |
| 56-15888 | 3/1981 | Japan . |

OTHER PUBLICATIONS

Kirk-Othmer Encyclopedia of Chemical Technology, 3rd edition; vol. 5, pp. 587-590 (1979).

*Primary Examiner*—John Niebling
*Assistant Examiner*—David G. Ryser
*Attorney, Agent, or Firm*—James B. Haglind; Paul Weinstein

[57] ABSTRACT

A process for producing chlorine dioxide by oxidizing a hypochlorous acid solution to produce a chloric acid solution, and, electrolyzing the chloric acid solution to produce chlorine dioxide.

The novel process of the present invention provides a commercially viable process for producing the chloric acid and eliminates the formation of an acidic salt solution in the production of chlorine dioxide which requires disposal. Further, the process permits a reduction in the amount of acid required in the generation of chlorine dioxide.

17 Claims, 1 Drawing Sheet

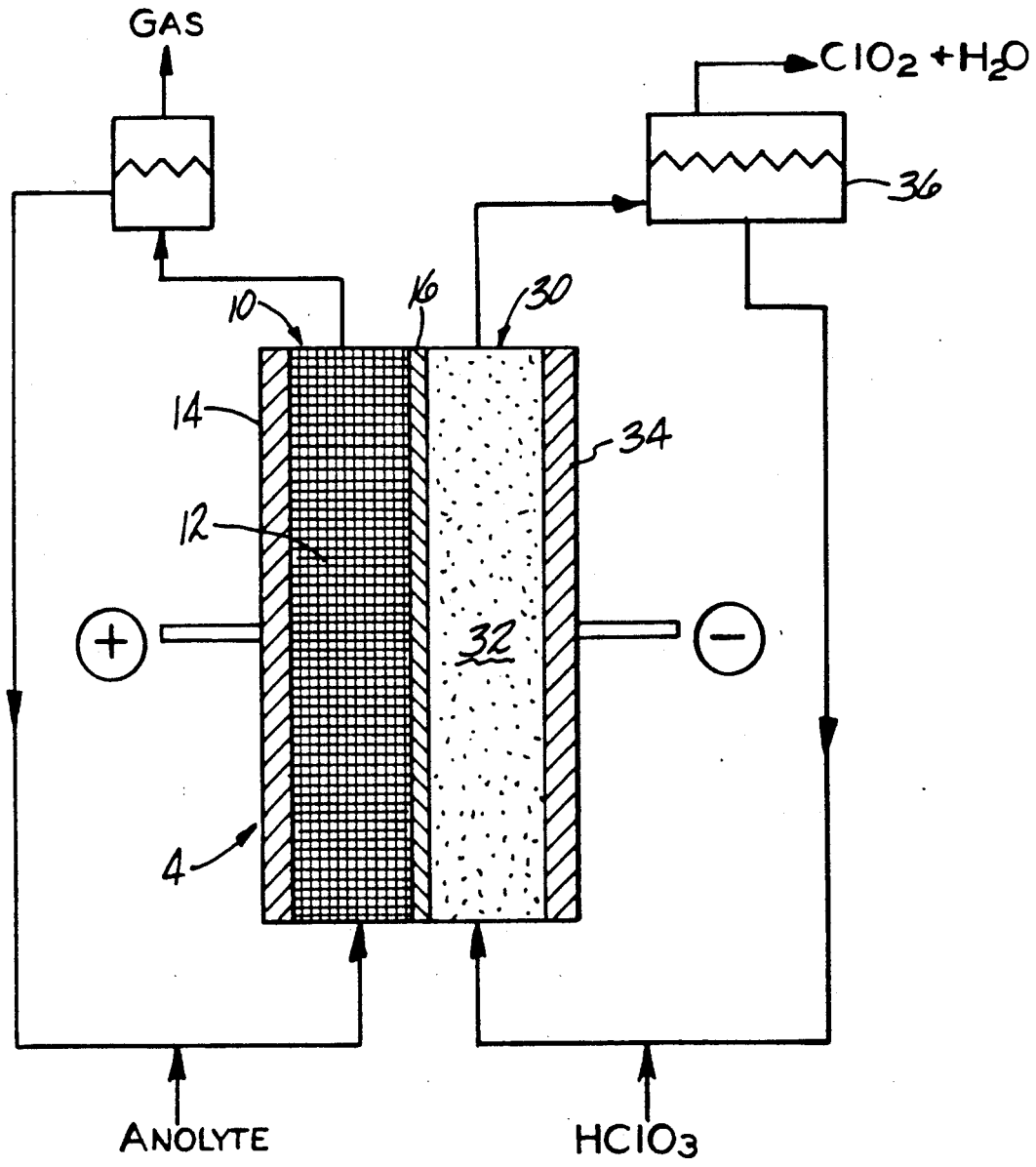
GAS
$ClO_2 + H_2O$
36
10
16
30
14
34
12
32
4
ANOLYTE
$HClO_3$

ELECTROCHEMICAL PROCESS FOR PRODUCING CHLORINE DIOXIDE FROM CHLORIC ACID

BACKGROUND OF THE INVENTION

This invention relates to a process for electrochemically producing chlorine dioxide. More particularly, this invention relates to the electrochemical production of chlorine dioxide from chloric acid.

Chlorine dioxide has found wide use as a disinfectant in water treatment/purification, as a bleaching agent in pulp and paper production, and a number of other uses because of its high oxidizing power. There are a number of chlorine dioxide generator systems and processes available in the marketplace. Most of the very large scale generators utilize a chlorate salt, a reducing agent, and an acid in the chemical reaction for producing chlorine dioxide.

Small scale capacity chlorine dioxide generator systems generally employ a chemical reaction between a chlorite salt and an acid and/or oxidizing agent, preferably in combination. Typical acids used are, for example, sulfuric or hydrochloric acid. Other systems have also used sodium hypochlorite or chlorine as the oxidizing agent in converting chlorite to chlorine dioxide. The disadvantage of the chlorine based generating systems is the handling of hazardous liquid chlorine tanks and cylinders and the excess production of chlorine or hypochlorite depending on the system operation.

The electrochemical production of chlorine dioxide has been described previously, for example, by J. O. Logan in U.S. Pat. No. 2,163,793, issued June 27, 1939.

The process electrolyzes solutions of an alkali metal chlorite such as sodium chlorite containing an alkali metal chloride or alkaline earth metal chloride as an additional electrolyte for improving the conductivity of the solution. The process preferably electrolyzes concentrated chlorite solutions to produce chlorine dioxide in the anode compartment of an electrolytic cell having a porous diaphragm between the anode and cathode compartments.

British Patent Number 714,828, published Sept. 1, 1954 by Farbenfabriken Bayer, teaches a process for electrolyzing an aqueous solution containing a chlorite and a water soluble salt of an inorganic oxy-acid other than sulfuric acid. Suitable salts include sodium nitrate, sodium nitrite, sodium phosphate, sodium chlorate, sodium perchlorate, sodium carbonate, and sodium acetate.

A process for producing chlorine dioxide by the electrolysis of a chlorite in the presence of a water soluble metal sulfate is taught by M. Rempel in U.S. Pat. No. 2,717,237, issued Sept. 6, 1955.

Japanese Patent Number 1866, published Mar. 16, 1956 by S. Saito et al (C.A. 51,6404, 1957) teaches the use of a cylindrical electrolytic cell for chlorite solutions having a porcelain separator between the anode and the cathode. Air is used to strip the $ClO_2$ from the anolyte solution.

Japanese Patent Number 4569, published June 11, 1958, by S. Kiyohara et al (C.A. 53, 14789d, 1959) teaches the use of a pair of membrane cells, in the first of which a concentrated $NaClO_2$ solution is electrolyzed in the anode compartment.

Air is used to strip the $ClO_2$ from the anolyte which is then fed to the cathode compartment by the second cell. NaOH, produced in the cathode compartment of the first cell, is employed as the anolyte in the second cell.

A process for producing chlorine dioxide by the electrolysis of an aqueous solution of lithium chlorite is taught in U.S. Pat. No. 3,763,006, issued Oct. 2, 1973 to M. L. Callerame. The chlorite solution is produced by the reaction of sodium chlorate and perchloric acid and a source of lithium ion such as lithium chloride. The electrolytic cell employed a semi-permeable membrane between the anode compartment and the cathode compartment.

Japanese Disclosure Number 81-115883, disclosed Dec. 7, 1981, by M. Murakami et al describes an electrolytic process for producing chlorine dioxide by admixinq a chlorite solution with the catholyte solution of a diaphragm or membrane cell to maintain the PH within the range of from 4 to 7 and electrolyzing the mixture in the anode compartment. The electrolyzed solution, at a pH of 2 or less, is then fed to a stripping tank where air is introduced to recover the chlorine dioxide.

More recently, an electrolytic process for producing chlorine dioxide from sodium chlorite has been described in which the chlorite ion concentration in the electrolyte is measured in a photometric cell to provide accurately controlled chlorite ion concentrations (U.S. Pat. No. 4,542,008, issued Aug. 17, 1985 to I. A. Capuano et al).

Those processes using alkali metal chlorites require the addition of an acid such as sulfuric acid or hydrochloric acid. The consumption of acid is a significant cost of these processes.

Further, these processes produce a by-product stream containing an alkali metal such as sodium in amounts not required in the process and which must be treated and disposed of as waste.

The electrolysis of an aqueous solution of alkali metal chlorate and alkali metal chloride in a three compartment electrolytic cell is taught in U.S. Pat. No. 3,904,496, issued Sept. 9, 1975 to C. J. Harke et al. The aqueous chlorate containing solution is fed to the middle compartment which is separated from the anode compartment by an anion exchange membrane and the cathode compartment by a cation exchange membrane. Chlorate ions and chloride ions pass into the anode compartment containing hydrochloric acid as the anolyte. Chlorine dioxide and chlorine are produced in the anode compartment and chloride-free alkali metal hydroxide is formed in the cathode compartment.

U.S. Pat. No. 3,810,969 issued May 14, 1974 to A. A. Schlumberger teaches a process for producing chloric acid by passing an aqueous solution containing from 0.2 gram mole to 11 gram moles per liter of an alkali metal chlorate such as sodium chlorate through a selected cationic exchange resin at a temperature from 5° to 40° C. The process produces an aqueous solution containing from 0.2 gram mole to about 4.0 gram moles of $HClO_3$.

K. L. Hardee et al, in U.S. Pat. No 4,798,715 issued Jan. 17,1989, describe a process for chlorine dioxide which electrolyzes a chloric acid solution produced by passing an aqueous solution of an alkali metal chlorate through an ion exchange resin.

The electrolyzed solution contains a mixture of chlorine dioxide and chloric acid which is fed to an extractor in which the chlorine dioxide is stripped off. The ion exchange resin is regenerated with hydrochloric acid and an acidic solution of an alkali metal chloride formed.

Processes which produce chloric acid in an ion exchange resin require the regeneration of the ion exchange resin with acid to remove the alkali metal ions and the treatment or disposal of the acidic salt solution.

SUMMARY OF THE INVENTION

Now a process has been discovered which produces chlorine dioxide while eliminating the formation of an acidic salt solution requiring disposal. Further, the process permits a reduction in the amount of acid required in the chlorine dioxide generator.

These and other advantages are accomplished in a process for producing chlorine dioxide which comprises oxidizing a hypochlorous acid solution to produce a chloric acid solution, and, electrolyzing the chloric acid solution to produce chlorine dioxide.

The novel process of the present invention employs as the starting material a high purity hypochlorous acid solution.

DETAILED DESCRIPTION OF THE INVENTION

One method of producing high purity concentrated HOCl solutions is that in which gaseous mixtures, having high concentrations of hypochlorous acid vapors and chlorine monoxide gas and controlled amounts of water vapor are produced, for example, by the process described by J. P. Brennan et al in U.S. Pat. No. 4,146,578, which is incorporated in its entirety by reference.

The gaseous mixture is then converted to a concentrated hypochlorous acid solution. An additional process for producing high purity HOCl solutions is that in which gaseous chlorine monoxide is dissolved in deionized water.

High purity hypochlorous acid solutions are substantially free of ionic impurities such as chloride ions and alkali metal ions as well as metal ions such as nickel and copper, among others.

In addition, the hypochlorous acid solutions have low concentrations of dissolved chlorine. For example, concentrations of the chloride ion in the hypochlorous acid solutions are less than about 50 parts per million, the alkali metal ion concentrations are less than about 50 parts per million, and nickel and copper ions are present in less than about 2 parts per million.

In the process of the invention, the high purity hypochlorous acid solution is oxidized to produce chloric acid. One process suitable for producing the chloric acid heats the hypochlorous acid solution at a temperature in the range of from about 25° to about 120° C. and recovers a solution of chloric acid.

This process is represented by the following reactions:

$$3HOCl \longrightarrow HClO_3 + 2HCl \quad (1)$$

$$2HOCl + 2HCl \longrightarrow 2Cl_2 + 2H_2O \quad (2)$$

$$5HOCl \longrightarrow HClO_3 + 2Cl_2 + 2H_2O \quad (3)$$

Thermal oxidation of the hypochlorous acid takes place at ambient temperatures and autogenous pressures. To increase the rate of production of chloric acid the reactant may be decomposed at elevated temperatures. The concentrated hypochlorous acid solution may be heated at temperatures, for example, in the range of from about 50 to about 120, and preferably in the range of from about 70° to about 110° C. to increase the rate of decomposition of the hypochlorous acid and hence the rate of production of chloric acid.

Another process for producing the high purity chloric acid utilizes anodic oxidation of hypochlorous acid in an electrolytic cell having an anode compartment, a cathode compartment, and an cation exchange membrane separating the anode compartment from the cathode compartment. In operation, the process includes feeding an aqueous solution of hypochlorous acid to the anode compartment, and electrolyzing the aqueous solution of hypochlorous solution at a temperature of from about 0° to about 40° C. to produce a chloric acid solution.

The process is represented by the following equation:

$$HOCl + 2H_2O \rightarrow HClO_3 + 2H_2 + 4e \quad (1)$$

The chloric acid solutions produced by the thermal or electrochemical oxidation include mixtures of chloric acid and hypochlorous acid, with perhaps small amounts of chlorine. Concentrated chloric acid solutions are produced, for example, by evaporation of a portion of the water. Any residual hypochlorous acid is decomposed during the concentration and the chlorine is evolved. Suitably the chloric acid solution is heated at temperatures above about 40° C., for example at temperatures in the range of from about 40° to about 120° C., preferably at from about 70° to about 120° C. and more preferably at from about 95° to about 120 ° C. It may be advantageous to employ a sealed reactor to concentrate the chloric acid solutions at the autogenous pressures attained.

Optionally, a dilute chloric acid solution can be concentrated by vacuum distillation at any suitable vacuum pressures such as those in the range of from about 0.01 to about 100 mm Hg.pressure.

In the novel process of the present invention the chloric acid is fed to the cathode compartment of an electrolytic cell which includes a compartment, an anode compartment, and a separator such as a cation exchange membrane positioned between the anode compartment and the cathode compartment

BRIEF DESCRIPTION OF THE DRAWINGS

The process of the invention is shown by the FIGURE which is a diagrammatic illustration of a system which can be employed.

The FIGURE shows an electrolytic cell 4 divided into anode compartment 10 and cathode compartment 30 by cation permeable ion exchange membrane 16. Anode compartment 10 includes anode 12, and anode backplate 14 behind anode 12 for distributing current to anode 12. Spent anolyte is circulated through gas separator 18 to remove gas products from the spent anolyte before recycle to anode compartment 10. Cathode compartment 30 includes cathode 32, and cathode backplate 34 distributes current to cathode 32. Chlorine dioxide gas produced is recovered from the spent chloric acid solution catholyte in gas separator 36 and the spent chloric acid solution recycled to cathode compartment 30.

The cathodes employed in the novel process of the present invention have high surface areas. High surface area cathodes include sheets, plates, or foils as well as porous structures which readily permit the flow of solution through the pores or openings of the cathode structure.

Suitable cathodes include those having a specific surface area greater than about 50 $cm^2/cm^3$ and having a total surface area greater than about 5 times the projected area of the membrane. Examples of suitable high surface area cathodes include multi-layered cathodes which have at least one layer having a porosity of at least 60 percent, and preferably from about 70 to about 90 percent, where the porosity is the percentage of void volume. Examples of multi-layered cathodes which may be used include those of U.S. Pat. No. 4,761,216, issued Aug 2, 1988 to D. W. Cawlfield and incorporated by reference herein.

Suitable cathode materials include graphite, graphite felt, a multiple layered graphite cloth, a graphite cloth weave, carbon, etc.. Precious metals such as gold, platinum group metals including platinum, palladium, iridium, rhodium or ruthenium; mixtures or alloys of these precious metals; thereof additionally the precious metals may be used Additionally oxides of iridium, rhodium or ruthenium, and mixture or alloys with other platinum group or precious metals could be suitably employed. Stainless steel, nickel or nickel-chrome based alloys, and titanium or other valve metals, each of which can also have a thin coating of a precious metal or a platinum group metal oxide may also be employed. For example, platinum electroplated on titanium or a platinum clad material could also be utilized for the cathode in conjunction with a gold, platinum, or platinum group metal oxide coated titanium cathode backplate. A thin deposited platinum conductive coating or layer on a corrosion resistant high surface area ceramic, or high surface area metallic fiber structure, such as titanium, or plastic fiber substrate could also be used.

An example of conductive stable ceramic electrodes include the materials sold by Ebonex Technologies Inc. under the trade name Ebonex(®).

The preferred structure of the cathode is a porous high surface area material of a compressible graphite felt or cloth construction. The graphite surfaces can be impregnated with metallic films or oxides to increase the life of the graphite. Other alternatives are fluoride surface treated graphite structures to improve the cathode useful life by preventing physical degradation.

Anodes which may be employed in the anode compartment, include those which are available commercially as dimensionally stable anodes. Prefered as anodes are porous or high surface area anodes having a high oxygen overvoltage.

Suitable anode materials include metals or metal surfaces consisting of platinum, gold, palladium, or mixtures or alloys thereof, or thin coatings of such materials on various substrates such as valve metals, i.e. titanium. Also commercially available oxygen evolution anodes of the type manufactured by Englehard (PMCA 1500) or Eltech (TIR-2000) are quite suitable. Graphite, graphite felt, a multiple layered graphite cloth, a graphite cloth weave, carbon etc. can also be used.

The anode backplate or current distributor distributes the current evenly to the porous, high surface area anode. The anode backplate can be similarly made of a graphite material which can be surface treated with agents such as those used on the porous, high surface area anode material.

Other alternative materials suitable for use in the current distributor include metallic films or oxides on stable, chemical oxidation resistant valve metal structures such as titanium, tantalum, niobium, or zirconium. The coating types are metallic platinum, gold, or palladium or other precious metal or oxide type coatings. There are other oxides such as ferrite based and magnesium or manganese based oxides which may be suitable.

A separator is positioned between the anodes and the cathodes in the electrolytic cell. The separator prevents, for example, oxygen gas formed at the anode from passing into the cathode compartment. Suitable separators include microporous medium, such as battery separators where the material of construction is, for example, a polyolefin such as polyethylene, polyvinylchloride, etc., or mats of chemically inert materials such as glass fiber. Other separators which can be employed include cation exchange membranes which are inert, flexible and substantially impervious to the hydrodynamic flow of the electrolyte in the passage of gas products produced in the cell. Cation exchange membranes are well known to contain fixed anionic groups that permit intrusion and exchange of cations and exclude anions from an external source. Suitable cation exchange membranes are sold commercially by E. I. DuPont de Nemours & Company, Inc., under the trademark "NAFION"; by the Asahi Glass Company, under the trademark "FLEMION", and by the Asahi Chemical Company, under the trademark "ACIPLEX".

During cell operation the separator is preferably in contact with the anode and the cathode to provide a zero gap between the electrodes.

Optionally a thin porous spacer material such as a chemically resistant non-conductive plastic mesh or a conductive material like graphite felt can be positioned to permit the adjustment of the gap between the electrode and the cation permeable ion exchange membrane, for example, when using high open area expanded metal electrodes. The porous spacer material preferably has large holes for ease of disengagement of the gases from the anolyte and/or catholyte.

The electrolysis process is carried out at catholyte temperatures in the range of from about 40° to about 90°, and preferably at temperatures of form about 50° to about 80° C.

The anode compartment may contain an anolyte, which can be an aqueous solution of any non-oxidizable acid electrolyte which is suitable for conducting hydrogen ions through the ion exchange membrane into the cathode compartment. Non-oxidizable acids which may be used include sulfuric acid, perchloric acid, nitric acid and the like at concentrations in the range of from about 2 to about 40 percent by weight.

In one embodiment, the anolyte is a solid state acid such as a perfluorosulfonic acid resin (sold commercially by E. I. DuPont de Nemours & Company, Inc., under the trademark "NAFION") which is used with deionized water which is fed to the anode compartment.

In an alternate embodiment, where the anode is in contact with the separator, no anolyte is employed and the membrane is wetted by water passing through the membrane from the cathode compartment. In this case, a gas such as air or nitrogen may be used to purge any gasses present in the anode compartment.

Where hydrogen ions are generated in the anode compartment, the hydrogen ions pass through the cation exchange membrane into cathode compartment to increase the acidity of the chloric acid solution.

The rate of production of chlorine dioxide may be increased by the presence of catalysts in the cathode compartment. Suitable catalysts include soluble metal salts of manganese, chromium, silver, and antimony, among others. In addition, inorganic acids such as sulfuric acid, perchloric acid, and phosphoric acid, among others may also be used.

In contrast to processes previously described, the catalysts are not consumed nor are they removed, for example in by-product streams. Any suitable amounts of the catalysts may be used which will desirably increase the reaction rate.

The product of the process of the invention is a mixture of gaseous chlorine dioxide and chloric acid also containing water vapor, small amounts of hydrogen gas and trace amounts of chlorine gas. After removal from the cell, the mixture is preferably passed to a stripping chamber to remove the chlorine dioxide and sufficient amounts of water vapor to maintain a water balance with the water being added with the chloric acid solution. Stripping of the gases from the chloric acid solution may be accomplished in several ways including sparging with a gas such as air or nitrogen, or applying a vacuum to the solution.

Concentrations of chlorine dioxide produced include those in the range of from about 0.5 to about 10, and, preferably from about 1 to about 6 percent by volume.

The spent chloric acid solution is preferably recycled after replenishing the chloric acid required.

The novel process of the present invention is further illustrated by the following example with no intention of being limited thereby. All parts and percentages are by weight unless otherwise indicated.

EXAMPLE 1

The cathode compartment of an electrolytic cell of the type illustrated by the FIGURE is initially filled with an aqueous solution containing a mixture of of 35% chloric acid and about 40% sulfuric acid. The cathode compartment contains a cathode which might optimally be formed from 5–50 micron diameter graphite fibers compressed to form a structure having about 80–90% porosity and having a specific surface area of at least about 300 $cm^2/cm^3$. The cathode would completely fill the cathode chamber having dimensions 10 centimeters wide, 60 centimeters tall, and 3 mm thick. During cell operation only the 35% chloric acid solution is added to the catholyte. The catholyte is continuously circulated at a velocity of about 3 centimeters per second through the thin cathode compartment. Both the anode and the cathode would be in contact with the separator, a cation permeable co fluoropolymer based membrane, such as Nafion ®117 (E. I. duPont de Nemours & Co.). A current density of 0.05 to 0.2 amps per square centimeter, or a total current of about 30 to 120 amps and would be passed at a voltage maintained at about 3 volts. The anode chamber would contain an oxygen evolving electrode and a solution of a non-oxidizable acid such as 10–20% by wt. of sulfuric acid. Hydrogen ions produced in the anode chamber would be transported through the cation permeable membrane to the cathode compartment. The product leaving the cathode chamber would contain about 1–5% chlorine dioxide and 1–4% chloric acid and would be passed to a stripping chamber where water vapor and chlorine dioxide would be withdrawn at a rate which would maintain a constant volume of catholyte.

The spent catholyte solution would be cooled and recycled to the cathode compartment. A process yield of about 95% based on chloric acid should be possible, and a current efficiency of about 95% should also be possible. Current inefficiency resulting in a very small amount of hydrogen gas would not affect the operability of the process.

What is claimed is:

1. A process for producing chlorine dioxide which comprises:

a) oxidizing a hypochlorous acid solution substantially free of ionic impurities to produce a chloric acid solution, and, b) electrolyzing the chloric acid solution to produce chlorine dioxide.

2. The process of claim 1 in which oxidizing the hypochlorous acid solution is accomplished by heating at a temperature in the range of from about 50° to about 120° C.

3. The process of claim 1 in which oxidizing the hypochlorous acid to chlorine dioxide solution is accomplished by anodically in an electrolytic cell.

4. The process of claim 3 in which reducing the chloric acid to chlorine dioxide is accomplished cathodically in an electrolytic cell.

5. The process of claim 4 in which reducing the chloric acid is accomplished at a temperature of from about 40° to about 90° C.

6. The process of claim 5 accomplished by admixing a catalyst with the chloric acid.

7. The process of claim 6 in which the catalyst is sulfuric acid.

8. The process of claim 1 in which recovering the chlorine dioxide is accomplished by stripping.

9. The process of claim 1 in which, after step a), concentrating the chloric acid solution is carried out.

10. A process for producing chlorine dioxide in an electrolytic cell having an anode compartment, a cathode compartment, and an ion exchange membrane separating the anode compartment from the cathode compartment, the process comprising:

a) oxidizing an aqueous solution of hypochlorous acid substantially free of ionic impurities to produce a chloric acid solution, and b) feeding the chloric acid solution to the cathode compartment, and, c) electrolyzing the chloric acid solution to produce a mixture of chlorine dioxide vapor and chloric acid.

11. The process of claim 10 in which oxidizing the hypochlorous acid solution is accomplished by heating at a temperature in the range of from about 50° to about 120° C.

12. The process of claim 10 in which oxidizing the hypochlorous acid solution is accomplished by anodically in an electrolytic cell.

13. The process of claim 10 in which stripping separates chlorine dioxide vapor from the chloric acid solution.

14. The process of claim 10 accomplished by admixing a catalyst with the chloric acid.

15. The process of claim 14 in which the catalyst is sulfuric acid.

16. The process of claim 5 in which the catalyst is an inorganic acid selected from the group consisting of sulfuric acid, perchloric acid, and phosphoric acid.

17. The process of claim 12 in which the catalyst is an inorganic acid selected from the group consisting of sulfuric acid, perchloric acid and phosphoric acid.

* * * * *

UNITED STATES PATENT AND TRADEMARK OFFICE

CERTIFICATE OF CORRECTION

PATENT NO. : 5,089,095

DATED : February 18, 1992

INVENTOR(S) : Cawlfield, et. al.

It is certified that error appears in the above-identified patent and that said Letters Patent is hereby corrected as shown below:

At column 1, line 68, after "NaOH", please delete "."

At column 5, line 68, after "stable" please delete","

At column 6, line 41, please delete "form" and insert ---from--- in its place.

At column 7, line 49, after "permeable" please delete "co".

Signed and Sealed this

Fourth Day of May, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,089,095

DATED : February 18, 1992

INVENTOR(S) : Cawlfield, et al

It is certified that error appears in the above-indentified patent and that said Letters Patent is hereby corrected as shown below:

Column 4, line 41, between "includes a" and "compartment", insert --cathode--.

Column 8, line 18, delete "to chlorine dioxide"

Column 8, line 19, delete "by".

Column 8, line 24, after "acid" insert -- to chlorine dioxide--.

Signed and Sealed this

Twelfth Day of October, 1993

*Attest:*

*Attesting Officer*

BRUCE LEHMAN

*Commissioner of Patents and Trademarks*